US010472103B2

(12) United States Patent
Durow

(10) Patent No.: US 10,472,103 B2
(45) Date of Patent: Nov. 12, 2019

(54) FRUIT PACKAGING CONTAINERS

(71) Applicant: Orchard View Farms, Inc., The Dalles, OR (US)

(72) Inventor: Ryan Durow, The Dalles, OR (US)

(73) Assignee: Orchard View Farms, Inc., The Dalles, OR (US)

( * ) Notice: Subject to any disclaimer, the term of this patent is extended or adjusted under 35 U.S.C. 154(b) by 0 days.

(21) Appl. No.: 15/623,921

(22) Filed: Jun. 15, 2017

(65) Prior Publication Data

US 2017/0283159 A1 Oct. 5, 2017

Related U.S. Application Data

(63) Continuation-in-part of application No. 14/628,063, filed on Feb. 20, 2015, now abandoned.

(51) Int. Cl.
*B65D 85/34* (2006.01)
*B65D 81/20* (2006.01)
(Continued)

(52) U.S. Cl.
CPC ..... *B65B 25/046* (2013.01); *B65B 7/02* (2013.01); *B65B 25/041* (2013.01);
(Continued)

(58) Field of Classification Search
CPC ..... B65B 25/04; B65B 25/041; B65B 25/046; B65B 25/001; B65B 7/02; B31B 2120/402–407; B65D 85/34; B65D 85/345; B65D 77/02; B65D 77/06; B65D 77/062; B65D 25/16; B65D 75/008
(Continued)

(56) References Cited

U.S. PATENT DOCUMENTS 2,766,927 A 10/1956 Wallace
2,821,337 A 1/1958 Morgan, Jr.
(Continued)

FOREIGN PATENT DOCUMENTS

CA 2323893 A1 * 9/1999 ..... B65D 33/01
CN 102030151 4/2011
(Continued)

OTHER PUBLICATIONS

Notification of the First Office Action for related Chinese Application No. 201610096209.1, dated Oct. 8, 2018, 24 pages (with English translation).
(Continued)

*Primary Examiner* — Stephen F. Gerrity
*Assistant Examiner* — Joshua G Kotis
(74) *Attorney, Agent, or Firm* — Klarquist Sparkman, LLP

(57) ABSTRACT

Described herein are sealable, breathable bags for packaging, storing, and transporting fresh fruit in boxes. The bags protects the fruit from outside contaminants while maintaining a modified atmosphere environment around the fruit to preserve the freshness of the fruit. Furthermore, the bags are constructed in such a way that they have a flattened closed configuration and an fully opened configuration that allows them to efficiently fit into a generally cuboid, open-topped packaging box to be filled with fresh fruit and then seal around the fruit in the box, such as by sliding a slider across an upper closure of the bag.

5 Claims, 7 Drawing Sheets

(51) Int. Cl.

| | |
|---|---|
| ***B65B 7/02*** | (2006.01) |
| ***B65B 25/04*** | (2006.01) |
| ***B65D 33/25*** | (2006.01) |
| ***B65D 77/02*** | (2006.01) |
| ***B65D 77/00*** | (2006.01) |
| *B65D 5/00* | (2006.01) |
| *B65D 77/04* | (2006.01) |

(52) U.S. Cl.
CPC ..... *B65D 33/2508* (2013.01); *B65D 33/2591* (2013.01); *B65D 77/003* (2013.01); *B65D 77/02* (2013.01); *B65D 81/20* (2013.01); *B65D 85/34* (2013.01); *B65D 5/0015* (2013.01); *B65D 77/0406* (2013.01); *B65D 81/2092* (2013.01)

(58) Field of Classification Search
USPC ..... 53/171, 174, 175, 434, 512, 459, 570, 53/469, 284.7, 138.3, 449; 220/62.21, 220/495.06, 495.08, 495.11
See application file for complete search history.

(56) References Cited

U.S. PATENT DOCUMENTS

| | | | | |
|---|---|---|---|---|
| 2,935,241 | A | 5/1960 | Brady | |
| 3,460,741 | A | 8/1969 | Kugler | |
| 3,484,037 | A | 12/1969 | Kugler | |
| 3,534,520 | A * | 10/1970 | Hamilton | B65B 43/04 383/122 |
| 3,549,451 | A | 12/1970 | Kugler | |
| 3,719,318 | A * | 3/1973 | Moran | B65D 31/00 24/30.5 T |
| 3,764,000 | A | 10/1973 | Jentsch | |
| 3,856,064 | A | 12/1974 | Swalleri | |
| 4,089,255 | A * | 5/1978 | Akoh | B65B 3/025 493/100 |
| 4,262,581 | A | 4/1981 | Ferrell | |
| 4,358,466 | A | 11/1982 | Stevenson | |
| 4,413,464 | A * | 11/1983 | Larsson | B65D 5/606 53/412 |
| 4,687,462 | A * | 8/1987 | Rewitzer | B65B 43/26 493/100 |
| 4,837,849 | A | 6/1989 | Erickson | |
| 4,848,930 | A | 7/1989 | Williams | |
| 4,932,556 | A | 6/1990 | Hui et al. | |
| 5,265,961 | A | 11/1993 | Boyd | |
| 5,279,537 | A * | 1/1994 | Lile | B31B 50/00 493/100 |
| 5,425,468 | A | 6/1995 | Birkel et al. | |
| 5,556,658 | A | 9/1996 | Raudalus et al. | |
| 5,617,711 | A | 4/1997 | Rodriguez et al. | |
| 6,036,363 | A | 3/2000 | Behnk | |
| 6,245,367 | B1 | 6/2001 | Galomb | |
| 6,254,907 | B1 | 7/2001 | Galomb | |
| 6,880,971 | B1 | 4/2005 | Huseman | |
| 7,614,430 | B2 | 11/2009 | Bergman et al. | |
| 8,122,687 | B2 * | 2/2012 | Kinigakis | B65B 9/093 493/213 |
| 8,220,651 | B2 | 7/2012 | Norcom | |
| 8,678,651 | B2 | 3/2014 | Schwallie et al. | |
| D742,245 | S | 11/2015 | Monforton | |
| 2002/0067865 | A1 | 6/2002 | Stutzman | |
| 2005/0091943 | A1 * | 5/2005 | Blake | B65B 7/02 53/434 |
| 2007/0189640 | A1 | 8/2007 | Linton | |
| 2009/0080810 | A9 | 3/2009 | Steele | |
| 2009/0208147 | A1 | 8/2009 | Steele | |
| 2010/0329591 | A1 | 12/2010 | Shibata | |
| 2011/0084077 | A1 | 4/2011 | James et al. | |
| 2011/0253562 | A1 * | 10/2011 | Machado | B65D 81/28 206/213.1 |
| 2012/0269465 | A1 | 10/2012 | Dorsey et al. | |
| 2014/0212068 | A1 | 7/2014 | Yu et al. | |
| 2016/0244242 | A1 | 8/2016 | Durow | |
| 2016/0244243 | A1 | 8/2016 | Durow | |
| 2018/0327161 | A1 * | 11/2018 | Helms | B65D 33/01 |

FOREIGN PATENT DOCUMENTS

| | | |
|---|---|---|
| CN | 202557971 | 11/2012 |
| CN | 203439492 | 2/2014 |
| FR | 2718717 | 10/1995 |
| WO | WO 2007/082347 | 7/2007 |

OTHER PUBLICATIONS

Chilean Office Action for related Application No. 2015-001181, dated Nov. 24, 2016, 8 pages.
Notification of the Second Office Action for related Chinese Application No. 201610096209.1, dated Mar. 4, 2019, 25 pages (with English translation).

* cited by examiner

FRUIT PACKAGING CONTAINERS

CROSS REFERENCE TO RELATED APPLICATION

The present application is a continuation-in-part of U.S. application Ser. No. 14/628,063, filed Feb. 20, 2015, which is incorporated by reference herein in its entirety.

FIELD

This application is related to bags and other packaging containers for fresh fruit, and especially commercially packaged fruit that is transported from one geographic region to another.

BACKGROUND

It can be difficult to keep fruit fresh from the time the fruit is harvested until the time is consumed. For example, some fruits are only available to be harvested in certain parts of the world during certain times of the year, but are desired for consumption all over the world and all year long. Thus, some fruits need to be kept fresh for several months while the fruit is packaged, stored, and transported around the world. When exposed to the ambient atmospheric gases and temperatures, many freshly harvested fruits will quickly ripen and then spoil in an undesirably short time. Furthermore, fresh fruit can be delicate and prone to bruising or other physical damage that devalues the fruit, and can be susceptible to pests and other contaminates that can harm the fruit. Therefore, there is a need for packaging technologies that can protect and preserve freshly harvested fruit in a way that maintains the freshness and overall quality of the fruit while it is packaged, stored, and transported.

SUMMARY

Described herein are sealable, breathable bags for packaging fresh fruit in boxes. The bags protects the fruit from pests and contaminants while maintaining a modified atmosphere environment around the fruit to preserve the freshness of the fruit. Furthermore, the bags are constructed in such a way that they have a flattened closed configuration and a fully opened configuration that allows them to efficiently fit into a generally cuboid, open-topped packaging box to be filled with fresh fruit.

Some embodiments of a sealable, breathable bag for packaging fresh fruit within an open-topped box comprise a front outer panel, a front inner panel, a rear inner panel, and a rear outer panel formed from a folded sheet of breathable polymeric material. In the flattened, closed configuration, the front outer panel transitions to the front inner panel along a first lower fold, the front inner panel transitions to the rear inner panel along an intermediate fold at upper ends of the front and rear inner panels, and the rear inner panel transitions to the rear outer panel along a second lower fold, such that the folded sheet forms a generally "W" shaped cross-sectional profile.

The four panels of the bag, along with the first and second lower folds and the intermediate fold, extend laterally along a length of the flattened bag between a first sealed side of the bag and an opposing second sealed side of the bag. The first sealed side of the bag includes a first lower sealed side and a first upper sealed side, and the second sealed side of the bag includes a second lower sealed side and a second lower sealed side. The first and second lower sealed sides comprise a joining of lateral edges of the all four panels below the intermediate fold, while the first and second upper sealed sides comprise a joining of the first lateral edges of just the front and rear outer panels above the intermediate fold.

The front and rear outer panels form an upper opening and an upper closure adjacent the upper opening. The upper closure is configured to selectively seal closed the upper opening with fresh fruit packaged within the bag such that a modified atmosphere environment can be created around the fresh fruit within the sealed bag.

The bag is in the fully open configuration when the bag is placed in an open-topped box having a rectangular lower panel, two rectangular end panels extending upward from opposing ends of the lower panel, and two rectangular side panels extending upward from opposing sides of the lower panel and extending between the two end panels. In the fully open configuration, the bag overlies an upper surface of the lower panel and inner surfaces of the two end panels and two side panels of the box, and the upper opening of the bag is spread apart with upper edges of the front and rear outer panels being positioned adjacent to or folded over upper edges of the two side panels and the two end panels of the box, such that fresh fruit can be placed inside the bag within the box.

In some embodiments, the lower sealed sides are longer than the upper sealed sides, such that the intermediate fold is closer to the upper edges of the bag than the lower end of the bag in the flattened, closed configuration.

In some embodiments, the breathable polymeric material is permeable to $CO_2$ and $O_2$.

In some embodiments, in the fully open configuration, the bag defines a generally cuboid open internal region that is generally the same size as an internal space defined by the box.

In some embodiments, in the fully open configuration, a middle portion of the intermediate fold is flattened out along the lower panel of the box such that the front inner panel and the rear inner panel of the bag overlie the lower panel of the box.

In the flattened, closed configuration, the bag can include a first interior pocket between the first outer panel and the first inner panel, between the first lower sealed side and the second lower sealed side, and above the first lower fold. The bag can also define a second interior pocket between the second outer panel and the second inner panel, between the first lower sealed side and the second lower sealed side, and above the second lower fold. In the flattened, closed configuration, an exterior pocket is also formed between the first inner panel and the second inner panel, between the first lower sealed side and the second lower sealed side, and below the intermediate fold.

In some embodiments, in the fully open configuration, the first interior pocket can be divided into a first interior corner pocket adjacent a first end panel of the box and a second interior corner pocket adjacent a second end panel of the box, and the second interior pocket can be divided into a third interior corner pocket adjacent the first end panel of the box and a fourth interior corner pocket adjacent the second end panel of the box. The four interior corner pockets can be generally triangular in shape, and can each be defined in part by one of the first or second lower sealed sides. The four interior corner pockets can each have an open upper end that extends from one of the first and second sealed sides of the bag.

In some embodiments, in the fully open configuration, the exterior pocket is divided into a first exterior end pocket adjacent a first end panel of the box and a second exterior end pocket adjacent a second end panel of the box. The first and second exterior end pockets can also be generally triangular in shape. The first and second exterior end pockets can have open lower ends that extend horizontally across a majority of the length of the respective end panels of the box.

The bag can also have a sealed configuration wherein the bag encloses fresh fruit within the box with the upper closure sealing the upper opening closed above the fresh fruit between the two end panels of the box, wherein in the sealed configuration a modified atmosphere environment is created around the fresh fruit within the bag.

The foregoing and other objects, features, and advantages of the disclosed technology will become more apparent from the following detailed description, which proceeds with reference to the accompanying figures.

DETAILED DESCRIPTION

Described herein are examples of fruit packaging containers, including sealable, breathable bags for packaging fresh fruit. The bags can be constructed in a manner that is simple to manufacture and use, provides sufficient strength and durability, protects the fruit from pests and contaminants, and maintains a desired internal gas environment around the fruit to preserve the freshness of the fruit.

Figure 1A:
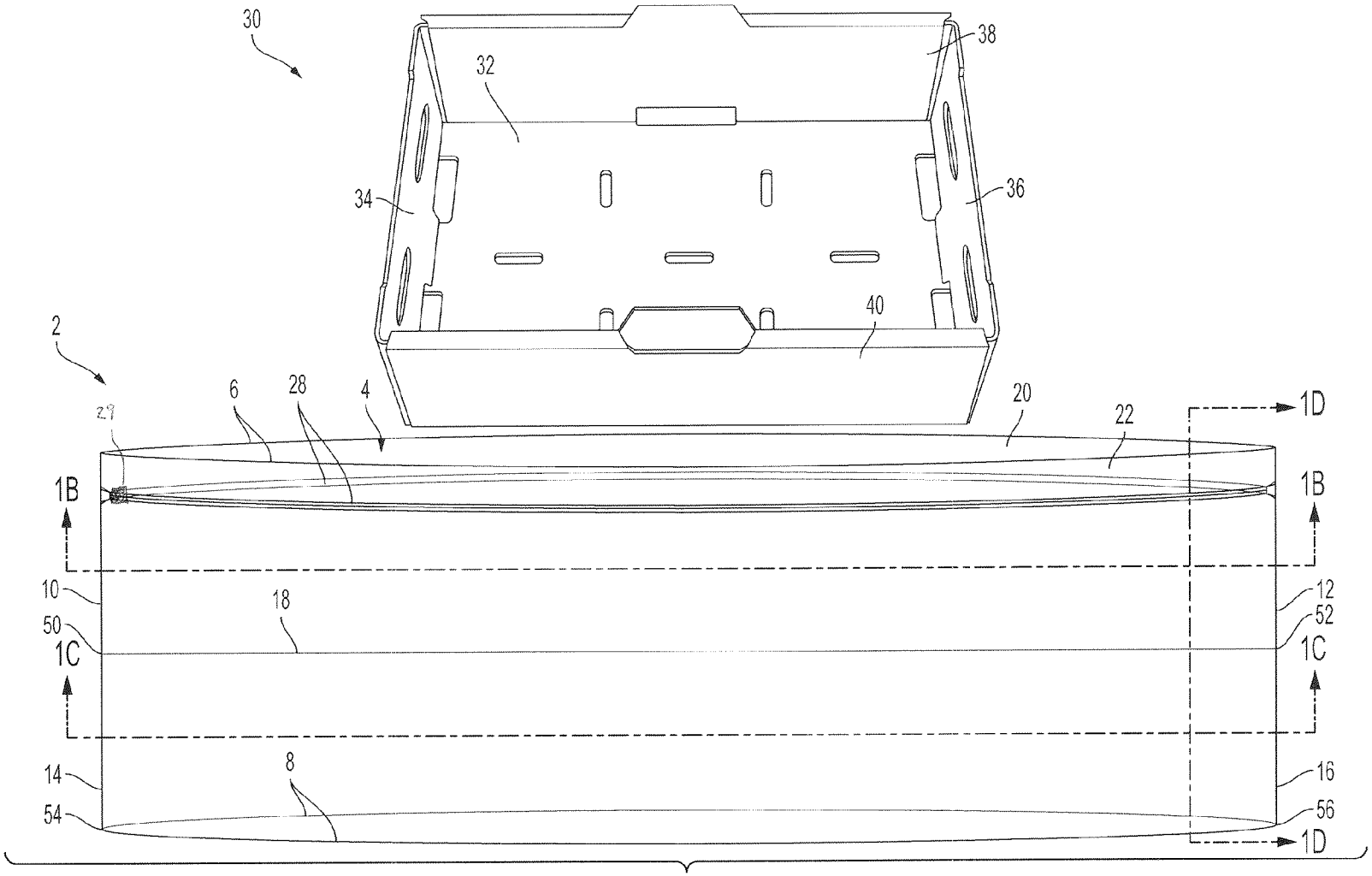
FIG. 1A shows an exemplary box and an exemplary sealable bag, in a flattened configuration, for packaging fresh fruit.
Figure 2A:
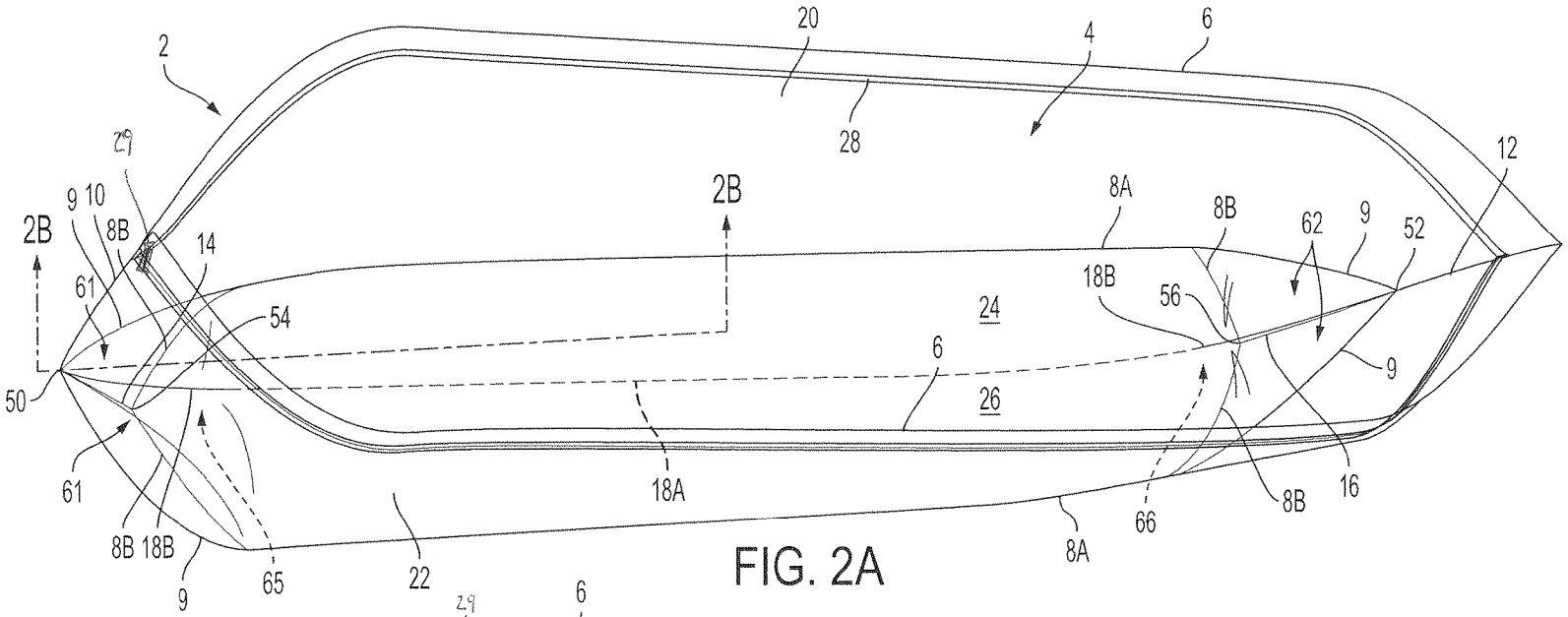
FIG. 2A is a perspective view of the bag of FIG. 1A, in a partially opened configuration.
Figure 3:
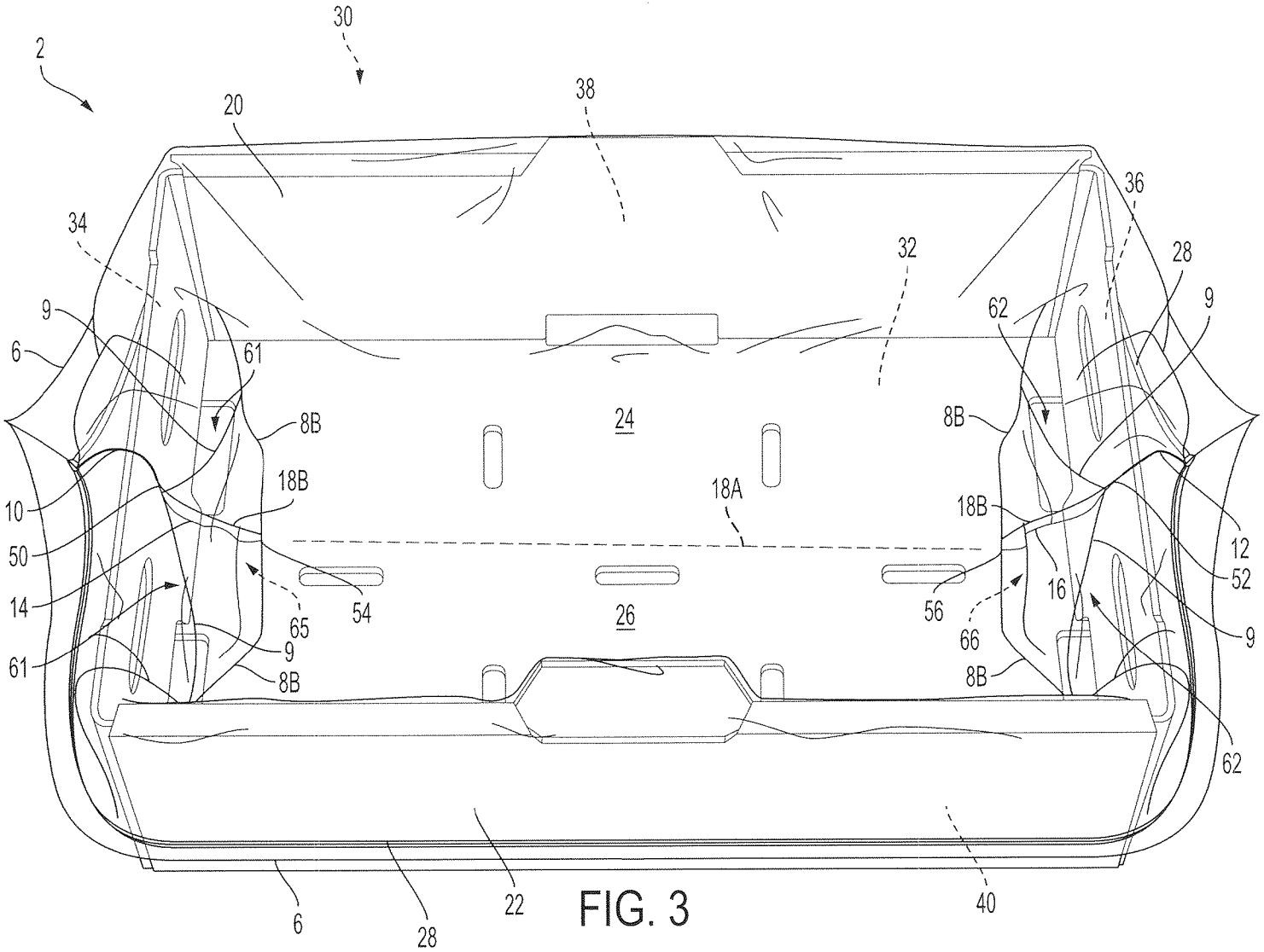
FIG. 3 shows the bag of FIGS. 1A and 2A in a fully open configuration and positioned in the box of FIG. 1A.
Figure 4:
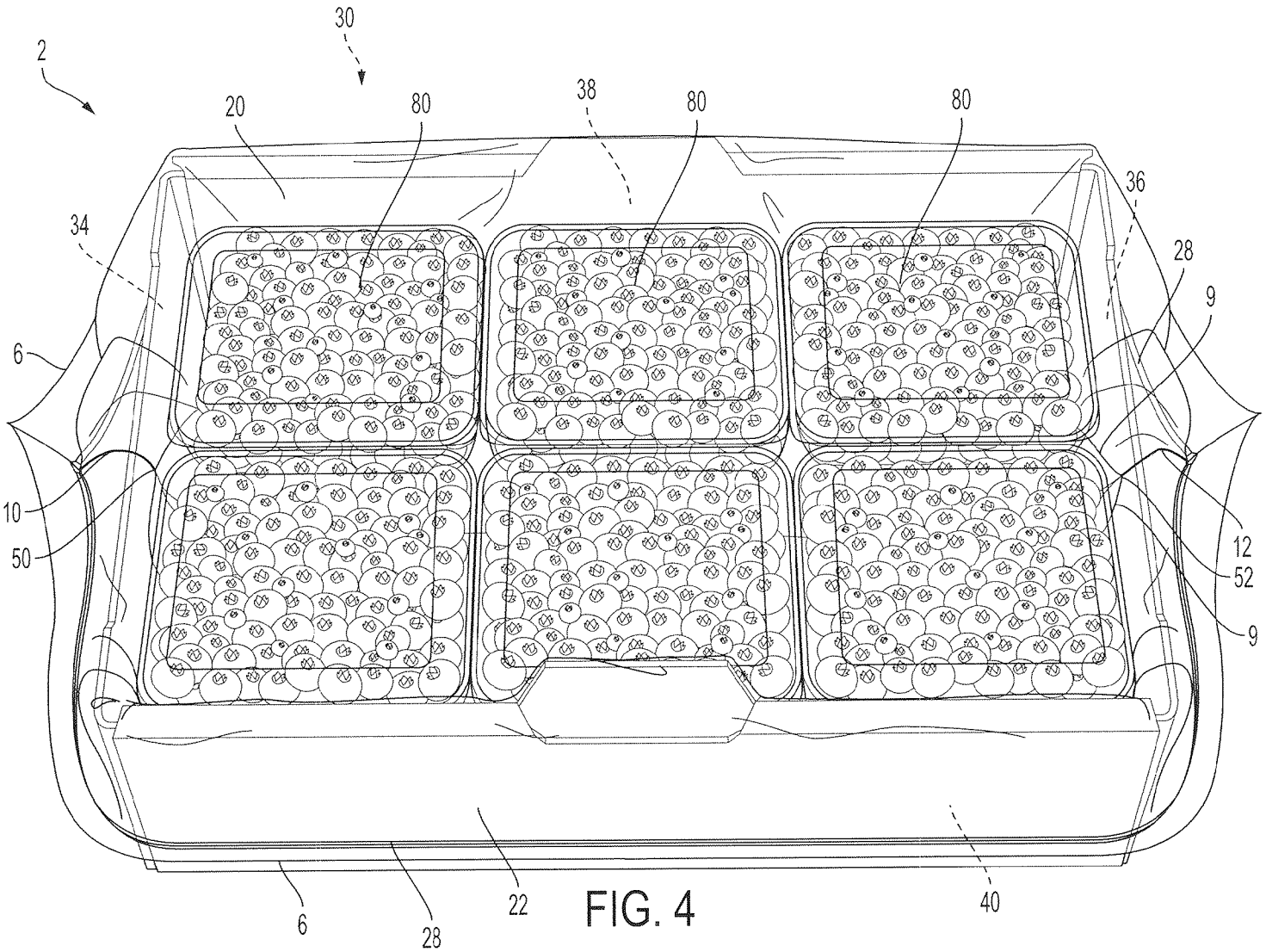
FIG. 4 shows the box and bag in the configuration of FIG. 3 with six cartons of fresh berries positioned in the bag and box.
Figure 5:
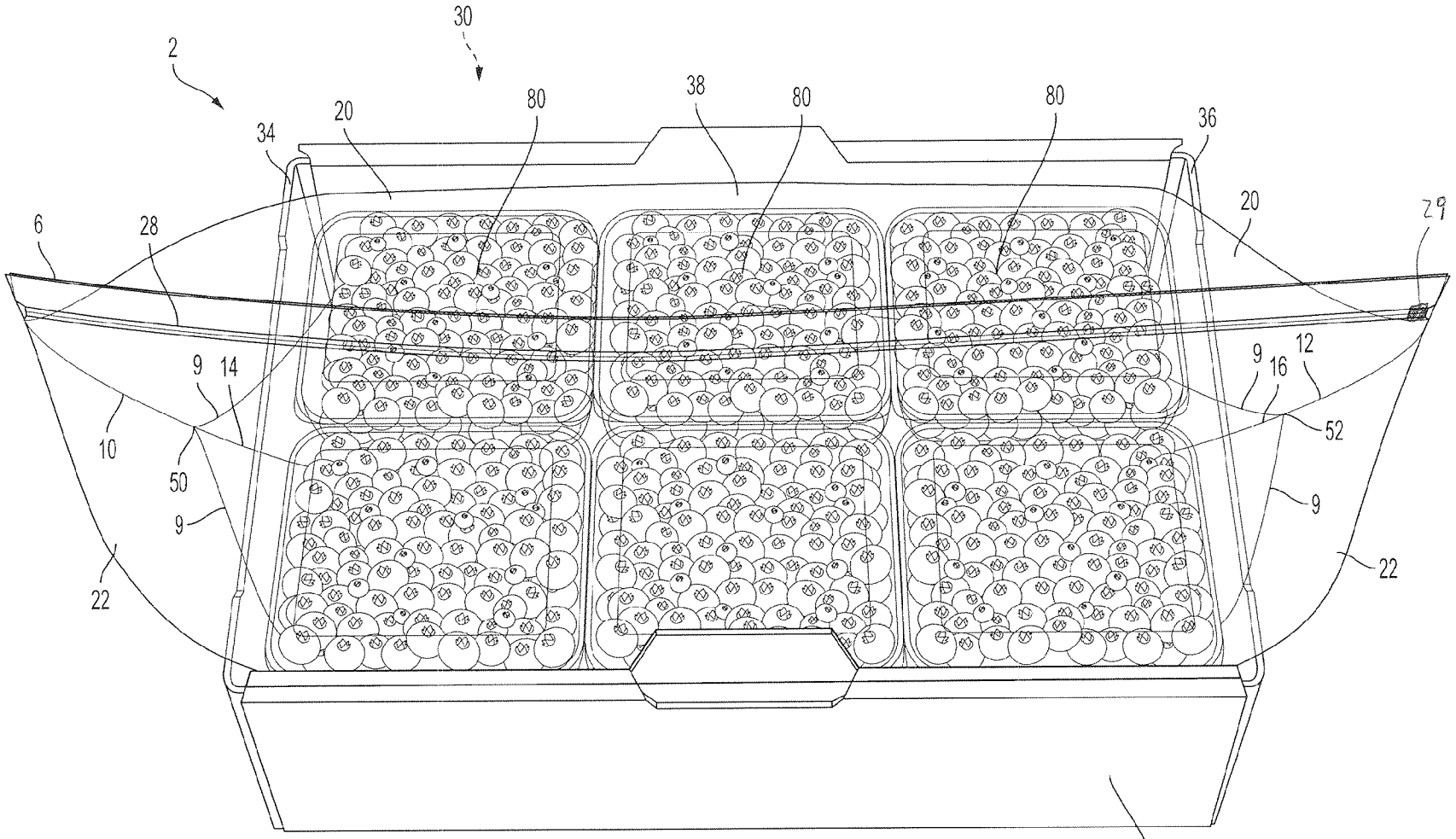
FIG. 5 shows the bag sealed closed around the fresh berries inside the box.

FIG. 1A shows an exemplary flexible, sealable bag 2 and an exemplary open-topped box 30 for packaging and transporting fresh fruit. FIG. 2A shows the bag 2 in a partially open configuration, and FIG. 3 shows the bag 2 in a fully open configurations and placed inside the box 30 with the bag's upper open end folded over the four sides of the box. In the fully open configuration of FIG. 3, fresh fruit 80 can be placed in the bag 2 and the box 30, as shown in FIG. 4, and the bag 2 can then be sealed around the fruit, as shown in FIG. 5. In the sealed configuration of FIG. 5, the box 30 can be stacked, stored, and/or transported while maintaining desired environment around the fruit until the fruit is ready to be displayed, sold, and/or consumed.

The disclosed containers can be used for packaging any type of fresh fruit, including berries, cherries, plums, kiwis, apples, etc.

The bag 2 can be breathable. The term "breathable" as used herein means that the material of the bag is permeable to, or allows transpiration of, certain gasses while being impermeable to other substances. For example, the bag 2 can be made from sheet material that is permeable to $CO_2$ and $O_2$. Such a breathable, sealable bag can be an example of modified atmosphere packaging (MAP), and can allow for the formation of a controlled gas environment, or modified atmosphere environment, when the fruit is sealed within the bag, which can help keep the fruit fresher longer and/or help control how fast the fruit ripens. The bag 2 can create a modified atmosphere environment around the fruit inside the sealed bag that comprises a different percentage of certain gases than the outside ambient air. For example, the bag 2 can create a modified atmosphere environment around the fruit with a higher percentage of $CO_2$ and/or a lower percentage of $O_2$ relative to the outside ambient air. Exemplary materials that can be used in the bag 2 include low density polyethylene (LDPE), linear low density polyethylene (LLDPE), nylon and nylon-based materials, high density polyethylene (HDPE), and polypropylene. One exemplary modified atmosphere packaging (MAP) material that may be used in the disclosed technology is sold under the trade name PEAKfresh®.

In some embodiments, the bag 2 can comprise a non-breathable material and/or a material not specifically designed to create a modified atmosphere environment. For example, some embodiments of the bag 2 can be used primarily for moisture retention.

The bag 2 can be formed from a single, four-sided (e.g., rectangular) sheet of material that is folded and permanently sealed along its lateral sides, as shown in FIGS. 1A-1D. The bag 2 includes a upper opening 4 between two upper edges 6 that extend laterally across the length of the bag, two lower folds 8 that extend laterally across the length of the bag, an intermediate fold 18 that extends laterally across the length of the bag, upper sealed side 10 and lower sealed side, or gusset, 14 of the one lateral end (left side of FIG. 1), and upper sealed side 12 and lower sealed side, or gusset, 16 on the opposite lateral end (right side of FIG. 1). The single sheet of material is folded in a generally "W" shaped pattern, as illustrated in the cross-sectional view of FIG. 1D, forming a rear outer panel 20, front outer panel 22, front inner panel 24, and rear inner panel 26, such that all four panels extend across the entire length of the bag.

The lower end of the outer rear panel 20 transitions to the lower end of the inner rear panel 24 at one of the lower folds 8, while the lower end of the outer front panel 22 transitions to the lower end of the front inner panel 26 at the other lower fold 8. The upper ends of the rear inner panel 24 transitions to the upper end of front inner panel 26 at the intermediate fold 18. FIG. 1B shows a horizontal cross-section take above the intermediate fold 18 and looking upwardly, such that only the outer panels 20 and 22 are visible, while FIG. 1C shows a horizontal cross-section take below the intermediate fold 18 and looking upwardly, such that all four panels 20, 22, 24, 26 and the fold 18 are visible. FIG. 1C illustrates that all four panels are joined together at their lateral ends to form the lower gussets 14, 16 that reinforce the ends of the bag.

The point at which the intermediate fold 18 intersects the left-hand edges of the panels is labeled at point 50 and the point at which the intermediate fold 18 intersects the right-hand edges of the panels is labeled at point 52. The portions of the lateral edges above the points 50 and 52 form the upper sealed sides 10 and 12 and include the joining of only the outer panels 20 and 22, as shown in FIG. 1B. The portions of the lateral edges below the points 50 and 52 form the lower sealed sides 14 and 16 and include the joining of all four of the outer panels 20, 22, 24, 26, as shown in FIG. 1C. The lower ends of the lower sealed sides 14, 16 are labeled with points 54 and 56. The points 54, 56 also represent the juncture of the lower folds 8 with the lower sealed sides 14 and 16.

Figure 1D:
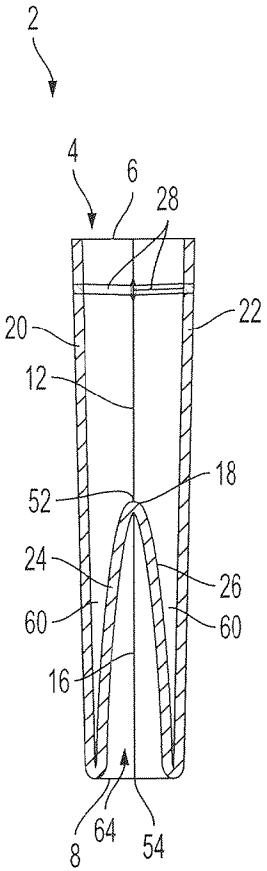
FIG. 1D is a vertical cross-sectional view of the bag of FIG. 1A.
Figure 1B:
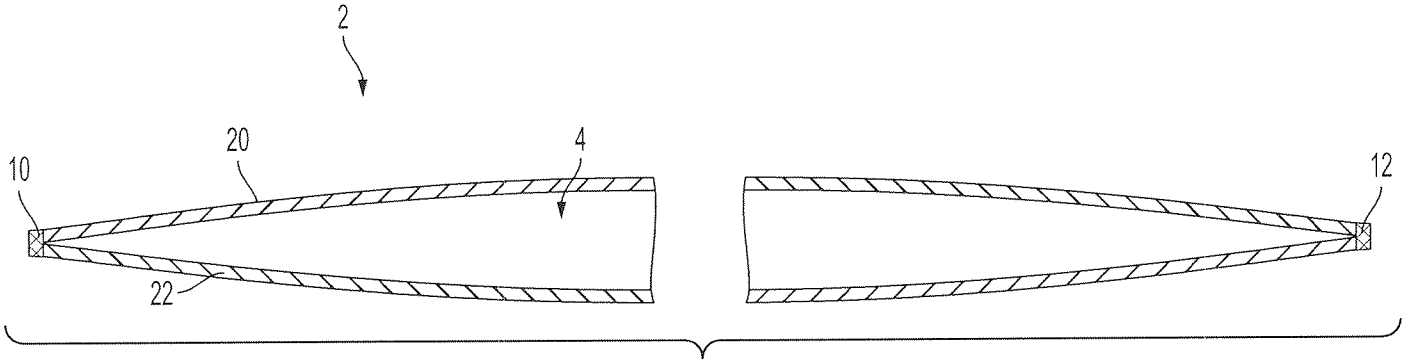
FIGS. 1B and 1C are horizontal cross-sectional views of the bag of FIG. 1A.
Figure 1C:
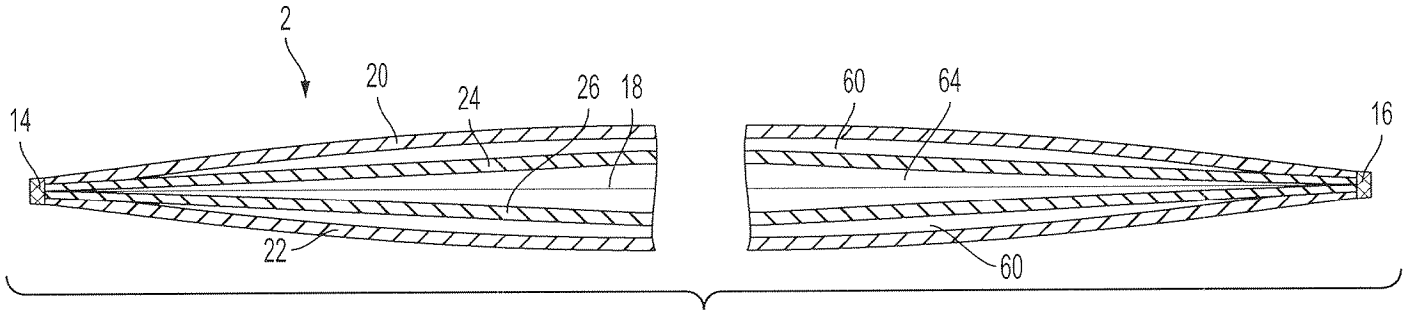

As shown in FIGS. 1C and 1D, in the flattened configuration the bag 2 can form two generally rectangular internal pockets 60 extending laterally between the lower sealed sides 14 and 16 and vertically between the intermediate fold 18 and the lower folds 8. One internal pocket 60 is between the rear outer panel 20 and the rear inner panel 24, while the other internal pocket 60 is between the front outer panel 22 and the front inner panel 26. As also shown in FIGS. 1C and 1D, in the flattened configuration the bag 2 can form a generally rectangular external pocket 64 that is between the two internal pockets 60 and extends laterally between the lower sealed sides 14 and 16 and vertically between the intermediate fold 18 and the lower folds 8.

The side-to-side length of the bag 2 can be sized to allow the upper opening to be folded over the upper perimeter of a particular box, such as the box 30 (see FIG. 3). Thus, the length of the bag (or at least the upper end of the bag) can be greater than one-half of the perimeter of the upper edges of the box (e.g., greater than the length plus the width of the box). For example, a bag with a length of 24 inches or greater can be suitable for use with a box having a length of 16 inches and a width of 8 inches (perimeter of 48 inches). This allows the upper opening the bag to fold over all four upper corners of the box, as shown in FIG. 3. In other embodiments, the bag can have a length of at least 12 inches, at least 16 inches, at least 18 inches, at least 20 inches, at least 22 inches, or at least about 30 inches.

The height of the bag can be selected to allow the bag to fit around whatever objects (e.g., cartons of fresh fruit) are being packed in the bag and remain easy to manipulate and seal the upper opening. Thus, the height can be greater than the height/depth of the box. Significant extra height can be provided to the bag to allow excess material to allow the bag to comfortably extend around the objects being packed inside the bag. In various embodiments, the bag can have a height of at least 6 inches, at least 7 inches, at least 8 inches, at least 9 inches, at least 10 inches, or at least about 12 inches. The bag 2 in FIG. 1A illustrates an exemplary bag having a length of about 24 inches and an overall height of about 9 inches.

The height of the gusseted lower portion of the bag can have any ratio relative to the overall height of the bag. For example, the lower sealed sides 14, 16 can be about equal in height (linear length of the seam) to the height of the upper sealed sides 10, 12. In other embodiments, the lower sealed sides 14, 16 can have a height that is greater than or less than the height of the upper sealed sides 10, 12. For example, in some embodiments, the lower sealed sides 14, 16 can have a height that at least one-third or at least one-fourth of the overall height of the bag. The sum of the heights of all four panels of the bag (e.g., two times the overall height plus two times the gusset height) can determine how far the bag can extend around the objects being packed in the bag in the width and height dimensions. For example, the sum of the heights of all four panels can be greater than the sum of two times the width of the box plus two times the height of the box. Since the upper closure 28 (see next paragraph) is located a distance below the upper edges of the bag, the heights described herein can be calculated based on the height of the upper closure 28 instead of the upper edges of the bag, to ensure the two sides of the closure can reach each other and seal together over the fruit.

The bag 2 can have an internal volume that varies based on the configuration of the bag. The minimum volume can be zero when in the flattened closed state. The maximum volume can be selected based on the size of the box and/or the volume and configuration of fruit desired to be packed inside the bag. The bag can have a maximum volume that is greater than the volume of the fruit to allow excess material such that the box can conform the shape of the box and seal above the fruit without being unduly stretched or strained. In some examples, the bag can have a volume of at least 5.6 quarts.

The bag 2 comprises an upper closure 28 that includes a longitudinal strip extending across both of the outer panels 20, 22 between the upper sealed sides 10, 12, which allows the upper portions of the outer panels to be selectively sealed together and unsealed, in order to manually open and close the bag around the fruit. The upper closure 28 can comprise, for example, a zipper, slider, Ziplock®-type structure, tongue-and-groove type structure, or similar structure. In other embodiments, the upper closure 28 can be permanently sealable, such as using a pressure-sensitive adhesive or the like. An exemplary slider 29 is shown in FIGS. 1A, 1E, 2A, 2B, and 5, mounted over upper closure 28. Sliding the slider 29 across the upper closure 28 in one direction causes the opposing sides of the upper closure to join together creating a seal, and sliding the slider in the other direction opens the upper closure. The slider can be slid partially across the upper closure to partially close the upper closure, leaving a gap for air to escape out through the upper closure when the partially closed bag is squeezed or compressed, which allows a person to squeeze out most of the air in the bag and then slide the slide the final distance across the upper closure to fully seal the deflated bag. This allows the bag to be sealed with minimal air inside the bag, and allows the a person to easily seal the bag without any tools or adhesives, and in a reversible and re-usable manner. This can save time compared to alternative methods of sealing a bag closed using a heat sealing machine, ties, or other methods. Compared to sealing a bag with a heat sealing machine, using a closure device such as a slider allows the user to quickly and securely close the bag without having to take the extra step of inserting the upper opening of the bag into a sealing machine and then permanently sealing the two panels together. The slider also allow a person to reopen and reclose the bag as many times as needed without loss of effectiveness. The slider closure method also saves time and cost compared to using a heat sealing method.

As shown in FIG. 1A, the box 30 can have any shape and size commensurate with the shape and size of the bag 2. The box 30 has a lower panel 32, end panels 34 and 36, side panels 38 and 40, and an open top. The box 30 can be comprised of corrugated paperboard, polymeric materials, metallic materials, and/or other materials sufficient to provide a rigid structure to support the fruit for stacking, storage, and transportation. The box 30 can optionally also comprise vents, drain holes, hand holes, stacking tabs, and/or other features. The box 30 and bag 2 can be sized to receive a particular volume of smaller packaging containers, such as the six blueberry containers 80 shown in FIGS. 4 and 5.

Prior to placing the smaller fruit containers 80 in the box 30, the bag 2 is placed in the box in the open configuration shown in FIG. 3. In this configuration, the upper edges 6 of the bag 2 are folded over the four vertical panels 32-38 of the box and out of the way so that the fruit containers 80 can be placed inside the bag 2 and the box 30 at the same time.

In some embodiments, the bag 2 can include permanent creases along the folds 8 and 18, while in other embodiments the folds 8 and 18 can simply comprise elastically bent regions that are not visible when the folds are unfolded. For example, when the bag 2 is opened up and placed into the box 30, as shown in FIG. 3, the intermediate fold 18 can flatten out along the bottom panel 32 of the box and no longer be visible. In other embodiments, a fold line or crease remains visible even when the fold is opened and laid flat. For this reason, the unfolded, flat portion 18A of the intermediate fold 18 is shown with a dashed line in FIGS. 2A and 3, while the lateral ends 18B of the fold 18 can remain partially folded and are shown with a solid line. In reality, the degree of folding can vary gradually over the fold 18, such that the fold 18 becomes gradually flatter moving inwardly from the points 50, 52 at the sealed sides to the fully flattened out portion 18A extending along the flat bottom panel 32 of the box. In the open configuration of FIG. 3, the lateral ends 18B of the intermediate fold 18 can curve gradually upwardly, or transition to a more vertical direction, moving from the flat portion 18A up to the end points 50 and 52, which can be located near the upper edge of the end panels 34 and 36.

A similar quality can also be true for the lower folds 8 of the bag. When the bag 2 is opened, the lower folds 8 flatten out, or unfold, along their middle portions 8A, which can be positioned near the junctures of the bottom panel 32 with the side panels 38 and 40 of the box 30. These middle portions 8A are shown with solid lines in FIG. 2A to indicate that in the open position the bag can remain partially folded, or can be curved, as the bag transitions from the more horizontal inner panels 24, 26 of the bag to the more vertical outer panels 20, 22 of the bag at the folds 8A. The lateral ends of the lower folds 8 are joined with the lower side seals 14 and 16 at the points 54 and 56, such that the lateral end portions 8B of the lower folds 8 gradually become more unfolded moving inwardly from the lateral end points 54, 56. In the open configuration of FIG. 3, the lateral end portions 8B of the lower folds 8 can extend along, or adjacent to, the juncture of the bottom panel 32 of the box and end panels 34, 36 of the box, such the lateral end portions 8B can be generally perpendicular to the middle portions 8A of the lower folds 8. Together, the two lower folds 8 can form a general rectangle extending around, or near to, the perimeter of the bottom panel 32 of the box 30.

Figure 2B:
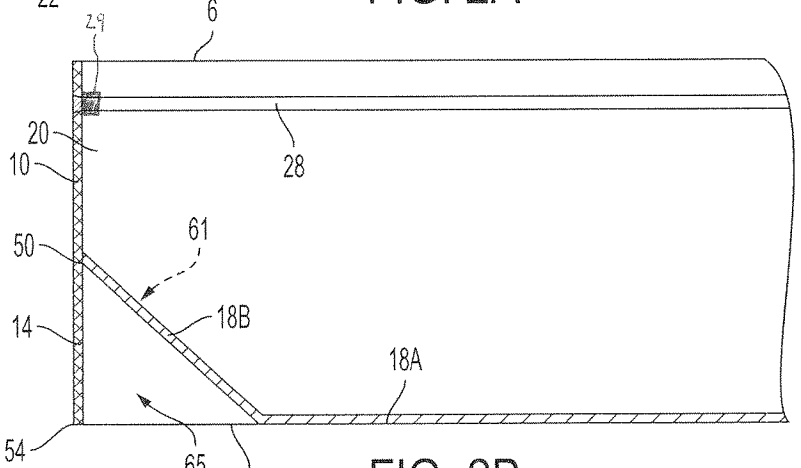
FIG. 2B is a partial cross-sectional view of a rear half of the bag in the partially open configuration of FIG. 2A.

As the bag 2 is opened from the flattened configuration of FIGS. 1A-1D to the open configurations of FIGS. 2A and 3, the two internal pockets 60 and the external pocket 64 (shown in FIGS. 1C and 1D) open up and flatten out along the middle portions 8A and 18A of the folds 8 and 18. At the same time, the lateral ends of the pockets 60 and 64 remain closed at the lower side seams 14 and 16, which cause the internal pockets 60 to divide into two left internal corner pockets 61 near the left lower side seam 14 and two right internal corner pockets 62 near the right lower side seam 16, and causes the external pocket 64 to divide into a left external pocket 65 and a right external pocket 66. As shown in FIGS. 2A and 2B, the two left internal corner pockets 61 are formed on either side of the left lateral portion 18B of the intermediate fold 18, while the two right internal corner pockets 62 are formed on either side of the right lateral portion 18B of the intermediate fold 18.

As shown in FIG. 2B, the left exterior pocket 65 (and similarly for the right external pocket 66) is defined generally between the lower side seam 14 and the sloping left end portion 18B of the intermediate fold 18. The left interior pockets 61 have a similar triangular profile as the left exterior pocket 65, but are closed on the lower side at 8B and are open on the sloped upper side.

When the bag 2 is in the fully open position of FIG. 3, the pockets 61, 62, 65, and 66 are generally flattened against the side ends 34, 36 of the box, with the two left internal pockets 61 being sandwiched between the left external pocket 65 and the left end panel 34, and the two right internal pockets 62 being sandwiched between the right external pocket 66 and the right end panel 36. Each of the internal pockets 61, 62 can cover about half the area of each of the external pockets 65, 66.

In the fully open configuration of FIG. 3, two diagonal folds 9 are created at either lateral side of the bag 2, each of which extends downwardly at an angle from the points 50 and 52 to the lower folds 8 (e.g., to the points where 8A and 8B meet and/or near the four internal corners of the box 30). These diagonal folds 9 define the upper sloped sides of the both the internal pockets 61, 62 and the external pockets 65, 66. For the four internal pockets 61, 62, the four folds 9 define the four openings of the pockets, while for the two external pockets 65, 66 the four folds 9 (in two groups or two) define the peaked upper limits of the two pockets.

In the configuration of FIG. 3, the bag 2 defines an internal region that closely matches the shape of the box 30, which can be a cuboid or close to a cuboid. The folds 8, 9, and 18 along with the sealed edges 10, 12, 14, 16 allow the bag 2 to assume such a cuboid shape with minimal wrinkling or overlapping material (except the triangular overlap areas around the pockets 61, 62, 65, 66 at the ends), thereby making efficient use of the bag material and maximizing the space remaining inside the box 30 for loose fruit or fruit containers such as the containers 80 shown in FIG. 4. The triangular pockets help the bag efficiently fill the box with minimal wasted material and provide manufacturing advantages due to the simplicity of making the bag.

Once the fruit is placed inside the bag 2 in the box 30, the upper edges 6 of the bag can be lifted up over the fruit and the upper closure 28 can be used to join the panels 20 and 22 together to fully enclose the fruit inside the bag 2, as shown in FIG. 5. The upper closure 28 can be closed by sliding the slider 29 across the upper closure to join the opposing sides of the upper closure together. The opposing sides of the upper closure can comprise a tongue-and-groove or zipper-type structure that engage together to form an air-tight seal, and the slider can be provided to close the upper closure. Excess air may first be squeezed out of the bag before the upper closure is fully sealed. Once sealed closed, the upper portions of the closed bag can then optionally be folded over the top of the fruit, tucked into the gaps between the sides of the fruit and the inner sides of the box, or left extending over the end panels 34, 36 of the box. In some embodiments, several of the boxes 30 with bag-enclosed fruit can be stacked on top of each other, such as by utilizing the stacking tabs on the side panels 38, 40. Later, the upper closures 28 can be reopened, such as by sliding the slider 29 the opposite direction, to access the fruit for display or consumption. While the bag 2 is closed, the breathability of the bag material can maintain a modified atmosphere while allowing the fruit to respire, preserving the freshness of the fresh fruit, slowing the ripening process or slowing the fruit's metabolism/respiration rate, blocking contaminates and pests from entering or exiting the bag, limiting odors and other unwanted gases from escaping, and maintaining moisture in the bag to reduce fruit weight loss (limit dehydration) and to preserve fruit firmness for prolonged shipping transit or storage times.

Figure 1F:
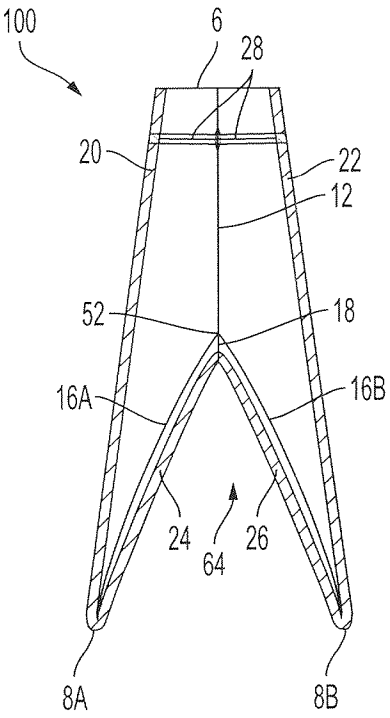
FIG. 1F is a vertical cross-sectional view of the bag of FIG. 1E.
Figure 1E:
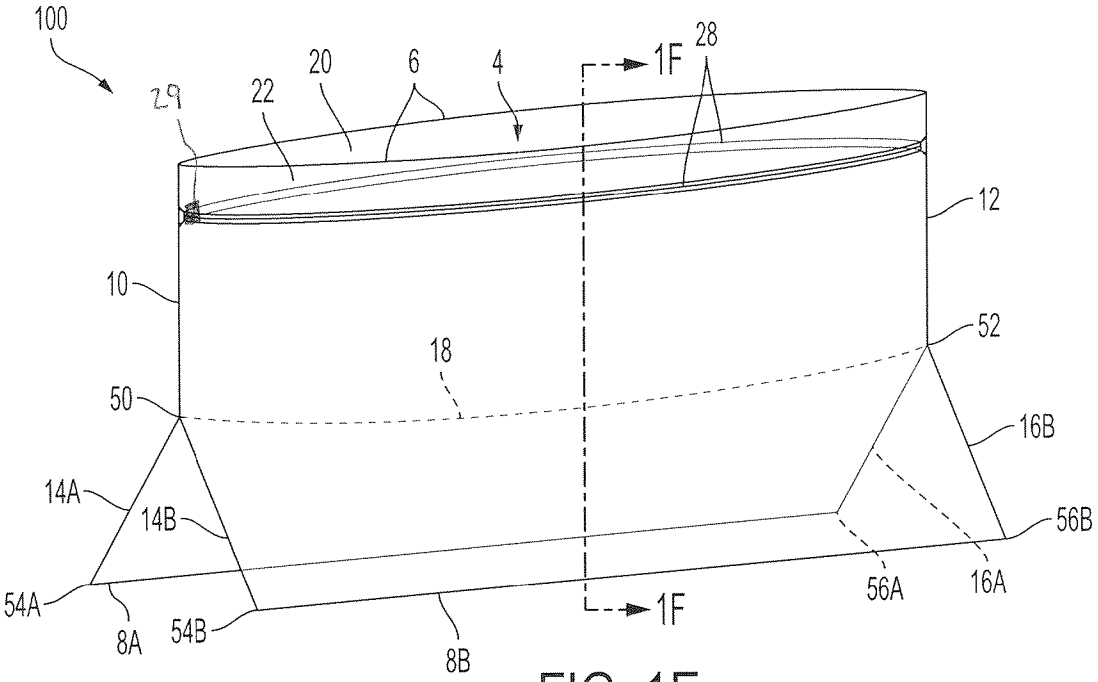
FIG. 1E is a perspective view of another exemplary sealable bag in a slightly opened configuration.

FIGS. 1E and 1F illustrate another exemplary bag 100 for packaging fresh fruit inside a box such as the box 30. The bag 100 can be similar to the bag 2 in all respects, except that the lower sealed sides, or gussets, 14 and 16 are each divided apart into two separate lower sealed sides, or gussets, 14A, 14B, 16A and 16B. Lower fold 8A extends between the lower ends 54A, 56A of gussets 14A and 16A, while lower fold 8B extends between the lower ends 54B, 56B of gussets 14B and 16B. The left-hand gussets 14A, 14B are joined at their upper ends at point 50, where they also join with the upper sealed side 10. Similarly, right-hand gussets 16A, 16B are joined at their upper ends at point 52, where they also join with the upper sealed side 12. As the bag 100 opens and the outer panels 20, 22 spread apart, the gussets 14A and 16A can pivot apart from the gussets 14B and 16B about the points 50 and 52, allowing the gussets to become more horizontally oriented and less vertically oriented. At the same time, the middle of the intermediate fold 18 flattens out (unfolds) and can bow downwardly from its end points 50 and 52 to allow the inner panels 24, 26 to spread apart from the outer panels 20, 22 and create an open volume inside the bag. When placed in a generally cuboid open-topped box, like the box 30, the lower ends 54A, 54B, 56A, 56B of the four gussets can extend to or near the four interior corners of the box, and the two lower folds 8A and 8B can be positioned along or near the junctures of the side panels 38, 40 with the lower panel 32, which allows the bag to efficiently cover the inside the box and allows the bag and box to be efficiently filled with fresh fruit.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

Any of the features or characteristics described herein in relation to any one or more of the described embodiments can also be used with or included in any of the other described embodiments where possible, even if such features or technologies are not specifically mentioned in direct connection to a specific embodiment.

Features, integers, characteristics, compounds, materials, or other descriptors provided in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

Although the operations of some of the disclosed methods are described in a particular, sequential order for convenient presentation, it should be understood that this manner of description encompasses rearrangement, unless a particular ordering is required by specific language. For example, operations described sequentially may in some cases be rearranged or performed concurrently. Moreover, for the sake of simplicity, the attached figures may not show the various ways in which the disclosed methods can be used in conjunction with other methods.

As used herein, the terms "a", "an", and "at least one" encompass one or more of the specified element. That is, if two of a particular element are present, one of these elements is also present and thus "an" element is present. The terms "a plurality of" and "plural" mean two or more of the specified element. As used herein, the term "and/or" used between the last two of a list of elements means any one or more of the listed elements. For example, the phrase "A, B, and/or C" means "A", "B,", "C", "A and B", "A and C", "B and C", or "A, B, and C." As used herein, the term "coupled" generally means physically coupled or linked and does not exclude the presence of intermediate elements between the coupled items absent specific contrary language.

In view of the many possible embodiments to which the principles of the disclosed technology may be applied, it should be recognized that the illustrated embodiments are only examples and should not be taken as limiting the scope of the disclosure. Rather, the scope of the disclosure is at least as broad as the following claims. We therefore claim all that comes within the scope of these claims.

The invention claimed is:

1. A method of packing fruit, comprising:

positioning a sealable bag in an open-topped box with an upper closure of the bag in an open configuration;

placing fruit within the bag after positioning the bag in the open-topped box;

closing the bag around the fruit while the bag and fruit are in the box; and sliding a slider across the upper closure of the bag to seal the upper closure closed with the fruit in the bag and in the box;

wherein the open-topped box comprises a rectangular lower panel, two rectangular end panels extending upward from opposing ends of the lower panel, and two rectangular side panels extending upward from opposing sides of the lower panel and extending between the two end panels, wherein the box comprises four interior corners defined where four corners of the lower panel meet the two rectangular side panels and the two rectangular end panels; and wherein the sealable bag comprises a front outer panel, a front inner panel, a rear inner panel, and a rear outer panel formed from a folded sheet of polymeric material;

wherein the bag has a flattened, closed configuration prior to being positioned in the open-topped box, wherein:

the front outer panel transitions to the front inner panel along a first lower fold, the front inner panel transitions to the rear inner panel along an intermediate fold at upper ends of the front and rear inner panels, and the rear inner panel transitions to the rear outer panel along a second lower fold, such that the folded sheet forms a generally W-shaped cross-sectional profile;

the front outer panel, the front inner panel, the rear inner panel, the rear outer panel, the first and second lower folds, and the intermediate fold extend laterally along a length of the bag between a first sealed side of the bag and an opposing second sealed side of the bag;

the first sealed side of the bag includes a first lower sealed side and a first upper sealed side, and the second sealed side of the bag includes a second lower sealed side and a second upper sealed side, the first lower sealed side comprises a joining of first lateral edges of the front outer panel, the front inner panel, the rear inner panel, and the rear outer panel below the intermediate fold, and the second lower sealed side comprises a joining of opposing second lateral edges of the front outer panel, the front inner panel, the rear inner panel, and the rear outer panel below the intermediate fold;

the first upper sealed side comprises a joining of the first lateral edges of the front outer panel and the rear outer panel above the intermediate fold, and the second upper sealed side comprises a joining of the second lateral edges of the front outer panel and the rear outer panel above the intermediate fold;

the first lower sealed side is longer than the first upper sealed side, and the second lower sealed side is longer than the second upper sealed side;

the front outer panel and the rear outer panel form an upper opening between the first upper sealed side and the second upper sealed side, and the front outer panel and the rear outer panel include the upper closure adjacent the upper opening, the upper closure including the slider configured to selectively seal closed the upper opening with fruit packaged within the bag;

a first interior pocket is defined between the first outer panel and the first inner panel, between the first lower sealed side and the second lower sealed side, and above the first lower fold; and a second interior pocket is defined between the second outer panel and the second inner panel, between the first lower sealed side and the second lower sealed side, and above the second lower fold; and an exterior pocket is defined between the first inner panel and the second inner panel, between the first lower sealed side and the second lower sealed side, and below the intermediate fold; and wherein positioning the sealable bag in the open-topped box comprises:

placing the bag in the box with the bag overlying an upper surface of the lower panel and inner surfaces of the two end panels and two side panels of the box;

flattening a middle portion of the intermediate fold along the lower panel of the box such that the front inner panel and the rear inner panel of the bag overlie the lower panel of the box;

spreading apart the upper opening of the bag and positioning upper edges of the front and rear outer panels adjacent to or folded over upper edges of the two side panels and the two end panels of the box;

dividing the exterior pocket into a first exterior end pocket adjacent a first end panel of the box and a second exterior end pocket adjacent a second end panel of the box, such that the first exterior end pocket has an open lower end that extends horizontally across a majority of the length of the first end panel of the box, and the second exterior end pocket has an open lower end that extends horizontally across a majority of the length of the second end panel of the box; and spreading the first and second interior pockets of the bag toward the four interior corners of the box, such that the first interior pocket is divided into a first interior corner pocket adjacent a first interior corner of the box and a second interior corner pocket adjacent a second interior corner of the box, and the second interior pocket is divided into a third interior corner pocket adjacent a third interior corner of the box and a fourth interior corner pocket adjacent a fourth interior corner of the box, and such that:

the four interior corner pockets are triangular in shape;

the four interior corner pockets are each defined in part by one of the first or second lower sealed sides; and the four interior corner pockets each have an open upper end that extends from one of the first and second sealed sides of the bag.

2. The method of claim 1, wherein sliding the slider across the upper closure of the bag to seal the upper closure closed comprises sliding the slider partially across the upper closure, and then squeezing air out of the bag, and then sliding the closure fully across the upper closure to seal the bag closed.

3. The method of claim 1, further comprising tucking an upper portion of the bag with the upper closure into the box between the fruit and side panels of the box.

4. The method of claim 1, wherein a modified atmosphere environment is created around the fruit within the bag when the upper closure is sealed closed.

5. The method of claim 1, wherein the bag comprises a breathable polymeric material that is permeable to $CO_2$ and $O_2$ and creates a modified atmosphere environment around the fruit within the bag when the upper closure is sealed closed.

* * * * *